US005490437A

United States Patent [19]

Hebert et al.

[11] Patent Number: 5,490,437

[45] Date of Patent: Feb. 13, 1996

[54] HAMMER

[76] Inventors: Paul W. Hebert, 6450 Lakeshore Dr., San Diego, Calif. 92119; Ted Floyd, 453 Grand Ave., Spring Valley, Calif. 91977; Larry C. Rogers, 9890 Cook Ave., Riverside, Calif. 92503; Dorothy L. Howe, 1112 Buena Vista, Spring Valley, Calif. 91977

[21] Appl. No.: 295,934

[22] Filed: Aug. 25, 1994

[51] Int. Cl.[6] ..... B25D 1/00; B25D 1/10

[52] U.S. Cl. ..... 81/22

[58] Field of Search ..... 452/22, 20, 489

[56] References Cited

U.S. PATENT DOCUMENTS

| | | | |
|---|---|---|---|
| 1,142,946 | 6/1915 | Ellis | 81/20 |
| 2,884,816 | 5/1959 | Lay | 81/20 |
| 2,960,133 | 11/1960 | Shepherd, Jr. | 81/20 |
| 3,208,724 | 9/1965 | Vaughan | 81/20 |
| 3,393,720 | 7/1968 | Fenlin | 81/20 |
| 3,612,121 | 10/1971 | Estwing | 81/20 |
| 3,613,753 | 10/1971 | Wolf | 81/20 |
| 3,927,432 | 12/1975 | Daal | 81/20 |
| 4,404,708 | 9/1983 | Winter | 81/22 |
| 5,280,739 | 1/1994 | Liou | 81/22 |
| 5,375,486 | 12/1994 | Carmien | 81/22 |

FOREIGN PATENT DOCUMENTS

| | | | |
|---|---|---|---|
| 43892 | 3/1931 | Denmark | 81/22 |

*Primary Examiner*—Willis Little
*Attorney, Agent, or Firm*—Charles C. Logan, II

[57] ABSTRACT

A hammer having a plastic molded handle. The rear end of the handle has a longitudinally extending bore hole that is filled with a gelatinous material that dissipates shock vibrations. An end cap is secured to the rear end of the handle by sonic welding. The front end of the handle has both a vertical and a horizontal longitudinally extending slot and these slots intersect each other at a substantially 90 degree angle. A plastic wedge unit formed from intersecting wedge sections is driven into the slots in the top end of the handle to secure the hammer head and the wedge unit is sonic welded to the handle.

11 Claims, 1 Drawing Sheet

28
12
10
14

28
20
12
26
22
L2
L1
18
21
38
36
16
X-AXIS 12
28

46
50
42
40
44

34
36

HAMMER

BACKGROUND OF THE INVENTION

The invention relates to a striking tool such as a hammer and it has particular reference to the novel handle for such a tool.

The user of a hammer or other hand-held striking tool desires that it be comfortable in use. The characteristics of the handle can contribute materially to comfort by minimizing the transmission of vibration to the hand upon striking an object with the head of the hammer.

The three materials commonly used in hammer handles are namely, metal, fiber-glass reinforced plastic ("fiberglass"), and wood. The vibration-absorbing quality of metal and fiberglass is poor. To improve their vibration-absorption, metal and fiberglass handles are often supplied commercially with rubber sheaths fitted over their gripping portions. Rubber sheaths also improve the anti-slip properties of the gripping portions. In some instances, these properties are further improved by providing holes or grooves in the surface of the sheath.

Some of the advantages of fiberglass handles is the fact that they are non-conductive, non-corrosive, non-decaying, and almost indestructible. The major disadvantages of fiberglass and metal handles is that they are heavier than wood handles and they do not dampen the vibrations the way a wooden handle does.

The Wolfe U.S. Pat. No. 3,613,753 discloses a hollow hammer handle formed of polymerized plastic material with continuous longitudinally tensioned glass fibers extending throughout its length. The rear end of the handle is covered by a grip which is preferably formed of rubber or other elastomeric material.

The Vaughn U.S. Pat. No. 3,208,724 discloses a hammer having a steel handle having a rubber sleeve to dampen the vibration received from the head of the hammer.

The Curati U.S. Pat. No. 4,165,771 discloses a fiberglass handle and structure for securely attaching it to the head of the hammer.

The Birdwell U.S. Pat. No. 4,268,927 discloses a hammer having a wooden handle with a hollow chamber in its base for receiving a drive piston for nail setting or driving screws.

It is an object of the invention to provide a novel plastic hammer handle that is at least as light or lighter than an equivalent wooden handle.

It is another object of the invention to provide a novel plastic handle for a hammer that will have vibration dampening properties equal to or better than that of a wooden handle.

It is also an object of the invention to provide a novel plastic handle for a hammer that is economical to manufacture and market.

It is a further object of the invention to provide a novel plastic handle for a hammer that is almost indestructible.

SUMMARY OF THE INVENTION

The novel hammer has an elongated handle that has been molded with long fiber reinforced nylon material. The long fiber thermoplastic reinforcements are the basis for the materials exceptional stiffness and impact strength. The handle material has a tensile strength in the range of 25,000–35,000 psi. It has a flexural strength in the range of 35,000–50,000 psi. The material forming the handle also has Rockwell hardness properties in the range of E50–E65 and it has a specific gravity in the range of 1.20–1.80. The material is nonconductive, noncorrosive and nondecaying. The nylon plastic has 40 to 50 percent of its content made of long fiber thermoplastics.

The rear end of the handle has a bore hole extending longitudinally along a substantial length of the handle. This bore hole is filled with a gelatinous material that absorbs shock vibrations. The specific gravity of the gelatinous material is in the range of 1.1–1.4 and it has a Rockwell hardness in the range of A20–A40. The gelatinous material would preferably be urethane and it can be made lighter in weight by adding styrene balls, air bubbles, or other material as filler. An end cap seals the end of the bore hole after it has been filled with gelatinous material. The end cap is sonic welded to the rear end of the handle.

An aluminum tube is positioned within the molded handle in its neck portion for increasing the handles strength at this critical location. It would preferably have an oval cross section with its height in the range of 0.400–0.600 inches and its width in the range of 0.300–0.500 inches. The aluminum tube would have a length in the range of 4–6 inches and its oval shape would be aligned with the oval shape of the handles cross section. The front end or head attachment portion of the handle has both a vertical and a horizontal longitudinally extending slot and these slots intersect each other at substantially a 90 degree angle. The inner surfaces of the respective slots have notches. A wedge unit formed of two intersecting wedge sections is made of plastic material and these wedge sections have vertically spaced horizontal barbs. As the wedge unit is driven into the slots, the barbs mate with the notches in the slots in a ratcheting manner until the wedge is driven to its innermost position. This is done after the hammer head has been placed over the front end of the handle. The final step involves sonic welding of the wedge to the head attachment portion of the handle.

DESCRIPTION OF THE PREFERRED EMBODIMENT

Figures 1, 2, 3, 4, 5:
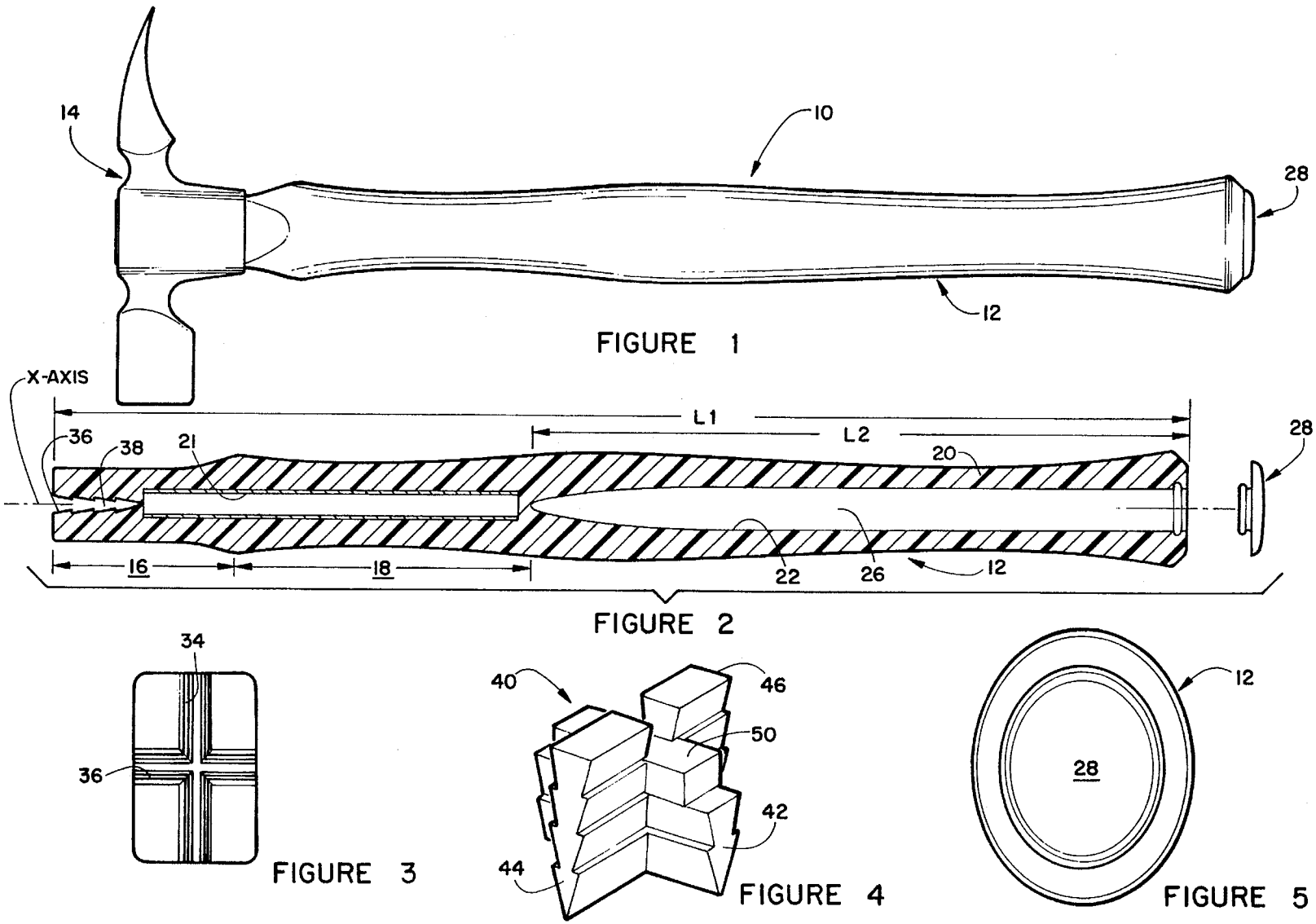
FIG. 1 is side elevation view of the novel hammer.
FIG. 2 is a cross sectional elevation view through the handle of the hammer.
FIG. 3 is an enlarged front end elevation view of the handle of the hammer.
FIG. 4 is an enlarged front perspective view of the wedge unit.
FIG. 5 is an enlarged front elevation view of the end cap.

The novel hammer will now be described by referring to FIGS. 1–5 of the drawing. The hammer is generally designated numeral 10. It has a handle 12 and a hammer head 14.

Handle 12 is made of long fiber reinforced nylon 6 material. Handle 12 has a head attachment portion 16, a neck portion 18 and a main body portion 20. An aluminum tubular member 21 is positioned in neck portion 18 to increase its strength. Tubular member 21 may be filled with the long fiber reinforced nylon 6 material. Handle 12 has a length L1 which is in a range of 12 to 16 inches. A bore hole 22 is formed in the rear end of handle 22 and it extends a length L2 and L2 is in the range of 0.25–0.80 L1. The chamber formed by bore hole 22 is filled with a gelatinous material 26 having a specific gravity in the range of 1.1 to 1.4 and having a Rockwell hardness in the range of A20–A40. An end cap 28 is sonic welded to the rear end of handle 12.

The head attachment portion 16 has longitudinally extending slots 34 and 36 that intersect each other at substantially 90 degree angles. The inner surfaces of the respective slots have notches 38 that are longitudinally spaced from each other. The wedge unit 40 is formed of two intersecting wedge sections 42 and 44 and it is driven into the top end of handle causing the front end of the handle to be wedged outwardly in four directions within the handle receiving central portion of the hammer head unit. The wedge sections have barbs 46 formed on their lateral surfaces that mate and ratchet into the respective notches 38 as the wedge unit is driven into the top end of the handle. The wedge unit is sonic welded in place. A magnet 50 is removably secured to the top surface of one of the wedge sections.

What is claimed is:

1. A hammer comprising:

an elongated handle having a longitudinally extending axis and a predetermined length L1; said handle having in sequence a front end, a head attachment portion, a neck portion, a main body portion, and a rear end;

said main body portion having a bore hole extending longitudinally inwardly from its rear end; said bore hole having a length L2 and L2 is in the range of 0.25–0.80 L1;

said bore hole being filled with a gelatinous material having shock dissipation properties; and an end cap secured to the rear end of said handle for sealing said bore hole.

2. A hammer as recited in claim 1 further comprising a hammer head secured on the head attachment portion of said handle.

3. A hammer as recited in claim 1 wherein said handle is made of long fiber reinforced thermoplastic having tensile strength in the range of 25,000–35,000 psi.

4. A hammer as recited in claim 3 wherein the material of which said handle is molded has a flexural strength in the range of 35,000–55,000 psi.

5. A hammer as recited in claim 4 wherein the material of which said handle is molded has Rockwell hardness properties in the range of E50–E65.

6. A hammer as recited in claim 3 wherein the material of which said handle is molded has a specific gravity in the range of 1.20–1.80.

7. A hammer as recited in claim 1 wherein said handle is made from nylon plastic having 40–50 percent of its content made of long fiber thermoplastics.

8. A hammer as recited in claim 1 wherein the front end of said handle has both a vertical and a horizontally extending slot and these slots intersect each other at a substantially 90 degree angle.

9. A hammer as recited in claim 1 wherein the specific gravity of said gelatinous material is in the range of 1.1 to 1.4.

10. A hammer as recited in claim 2 further comprising a plastic wedge and said handle being made of plastic material and said wedge is sonic welded to said head attachment portion to secure said hammer head thereto.

11. A hammer as recited in claim 10 wherein said wedge has intersecting wedge sections.

* * * * *